US006196710B1

(12) United States Patent
Swanson et al.

(10) Patent No.: US 6,196,710 B1
(45) Date of Patent: Mar. 6, 2001

(54) DUST DISTRIBUTOR FOR ASPHALT MIXING MACHINE

(75) Inventors: Malcolm L. Swanson, Chickamauga, GA (US); Gary R. Keylon, Plano, TX (US)

(73) Assignee: Astec Industries, Inc., Chattanooga, TN (US)

( * ) Notice: Subject to any disclaimer, the term of this patent is extended or adjusted under 35 U.S.C. 154(b) by 0 days.

(21) Appl. No.: 09/450,373

(22) Filed: Nov. 26, 1999

(51) Int. Cl.[7] ..... B28C 5/46

(52) U.S. Cl. ..... 366/7; 366/22; 366/25; 366/12; 34/131

(58) Field of Search ..... 366/4, 7, 12, 22, 366/23, 24, 25, 54; 432/103, 109, 3; 110/226; 34/131, 595, 135, 136

(56) References Cited

U.S. PATENT DOCUMENTS

| | | | | |
|---|---|---|---|---|
| 4,477,250 | * | 10/1984 | Brashears | 432/3 |
| 4,616,934 | | 10/1986 | Brock | 366/25 |
| 4,638,747 | | 1/1987 | Brock et al. | 110/264 |
| 4,715,720 | | 12/1987 | Brock | 366/25 |
| 4,854,941 | * | 8/1989 | Chedgy | 44/626 |
| 4,856,202 | * | 8/1989 | Radomsky | 36/4 |
| 4,867,572 | | 9/1989 | Brock et al. | 360/25 |
| 5,052,810 | | 10/1991 | Brock | 366/25 |
| 5,090,813 | | 2/1992 | McFarland et al. | 366/25 |
| 5,174,650 | * | 12/1992 | McFarland | 366/258 |
| 5,193,395 | * | 3/1993 | Musil | 405/128 |
| 5,209,563 | | 5/1993 | Swisher, Jr. et al. | 366/22 |
| 5,240,412 | * | 8/1993 | Mendenhall | 432/103 |
| 5,320,426 | | 6/1994 | Keylon et al. | 366/25 |
| 5,378,059 | | 1/1995 | Brock | 366/25 |
| 5,378,060 | | 1/1995 | Brock et al. | 366/25 |
| 5,383,725 | | 1/1995 | Swisher, Jr. et al. | 366/22 |
| 5,478,530 | * | 12/1995 | Swanson | 422/170 |
| 5,480,226 | | 1/1996 | Milstead | 366/7 |
| 5,538,340 | | 7/1996 | Brashears | 366/25 |
| 5,579,587 | * | 12/1996 | Morrison | 34/135 |
| 5,596,935 | * | 1/1997 | Swanson | 110/235 |
| 5,603,615 | * | 2/1997 | Liaw | 432/128 |
| 5,620,249 | | 4/1997 | Musil | 366/25 |
| 5,634,712 | * | 6/1997 | Musil | 366/22 |
| 5,664,881 | * | 9/1997 | Hawkins | 366/4 |
| 5,737,849 | * | 4/1998 | Morrison | 34/135 |
| 5,904,904 | * | 5/1999 | Swanson | 366/25 |
| 5,989,018 | * | 11/1999 | Musil | 432/109 |

* cited by examiner

*Primary Examiner*—Tony G. Soohoo
(74) *Attorney, Agent, or Firm*—Chambliss, Bahner & Stophel, P.C.

(57) ABSTRACT

An apparatus for making asphalt paving material includes a dust collection and distribution system by which aggregate dust that is collected during the heating and drying of aggregate may be introduced into the mixing chamber and distributed over a substantial portion of the area of the mixing chamber. By distributing the aggregate dust over a broader area of the mixing chamber than has been previously known, the mixing effort required to achieve a thorough blending of the dust into the mixture is reduced, and the quality of the asphalt paving composition is improved.

17 Claims, 6 Drawing Sheets

DUST DISTRIBUTOR FOR ASPHALT MIXING MACHINE

FIELD OF THE INVENTION

The present invention relates generally to a machine for manufacturing asphalt paving compositions, and more specifically, to a dust return/distribution system for such a machine. In a preferred embodiment of the invention, a dust return/distribution system is provided for a continuous-process hot-mix asphalt plant having a rotary drum dryer and a concentric fixed shell mixer.

BACKGROUND OF THE INVENTION

Machines for the manufacture of asphalt paving compositions are well-known. Hot-mix asphalt plants, for example, include a means for heating and drying aggregate and a means for mixing the heated and dried aggregate together with asphalt cement or liquid asphalt to form a paving composition.

Hot-mix asphalt plants typically include a rotating aggregate dryer in which aggregate is heated and dried before being mixed with asphalt cement, an asphalt cement supply system and a mixing tower or chamber where the aggregate and asphalt cement are mixed together. The dryer of this apparatus is typically oriented so as to have an upper end and a lower end, so that aggregate which is introduced into the dryer at the upper end will move towards the lower end by gravity flow and by the action of a series of flights mounted on the interior surface of the rotating dryer. A burner is located at the lower end of the dryer, and the hot air and exhaust gases from the burner move toward the upper end of the dryer, against the flow of the aggregate. As the aggregate is tumbled through the exhaust gases, the material is heated and dried. The hot, dry aggregate is discharged from the dryer at the lower end and introduced to a mixing tower or chamber where it is combined with asphalt cement or another binding material to form an asphalt paving composition or asphalt concrete mixture.

As the aggregate is tumbled and dried in the dryer, a quantity of dust is typically created and carried upwardly by the hot gases of combustion. Because of particulate emission regulations, it is unacceptable to exhaust the dust to the atmosphere. Furthermore, depending on the speed of rotation and the temperature at which the dryer is operated, the quantity of dust may represent a significant percentage of the fine aggregate material needed in the particular mix. Therefore, dust collection or recovery systems such as baghouses and cyclone separators are known for removal of the dust from the gas stream before further processing of the combustion gases and/or exhaustion to the atmosphere. The dust which is recovered in the dust recovery system may then be introduced to the mixing tower or chamber for inclusion in the asphalt mix. This introduction of recovered dust has generally been made through a single inlet which deposits the dust at a single point in the mixing chamber. While this single inlet method of dust introduction accomplishes the primary task of return of the dust to the mixing chamber, we have learned that the introduction of dust at more than one point in the mixing chamber allows the dust to be more readily combined with, and more evenly distributed throughout, the asphalt mix than if the dust is introduced at a single point in the mixing chamber.

Accordingly, there is a need to provide an improved apparatus for manufacturing asphalt paving compositions which may avoid or minimize the mixing problems that result from the introduction of recovered dust at a single point in the mixing chamber.

ADVANTAGES OF THE INVENTION

Among the advantages of the present invention is its provision of an improved apparatus for manufacturing asphalt paving compositions which minimizes the problems caused by the introduction of the recovered dust into the mixing chamber at a single point. This improvement is provided by introducing and dispersing the recovered aggregate dust over a substantial portion of the area of the mixing chamber. Another advantage of the invention is that the mixing effort required to achieve a thorough blending of the dust into the mixture is reduced by dispersing the dust over a substantial portion of the area of the mixing chamber.

Other objects, advantages and features of the present invention will become apparent to those skilled in the art to which the invention relates from an examination of the drawings and the ensuing description.

EXPLANATION OF TECHNICAL TERMS

As used herein, the terms asphalt paving composition, asphalt paving material and asphalt concrete mixture refer to mixtures of various aggregates, including crushed stone, sand, lime, dust and the like, with asphalt cement or asphalt binder, which mixtures are prepared for paving purposes. Asphalt paving materials that are prepared or manufactured in a process employing heat may be referred to as hot-mix asphalt, and the equipment that is used to make hot-mix asphalt may be referred to as a hot-mix asphalt plant.

As used herein, the terms asphalt cement and asphalt binder refer to the binding material which is added to the aggregate and other materials in the mixing chamber of a hot-mix or other asphalt plant to form asphalt paving material.

As used herein, the term mixture refers to the combination of materials, including at least some fluid or partially fluid materials, in the mixing chamber of a machine or plant for the manufactured or production of asphalt paving material.

As used herein, the term mixing chamber refers to the portion of the asphalt manufacturing plant or equipment where the dried aggregate and asphalt cement are mixed together.

As used herein, the term dust refers to the aggregate fines and particulates which are entrained in the (gases of combustion as the aggregate is dried in a hot-mix asphalt plant.

SUMMARY OF THE INVENTION

We have observed that the quality of an asphalt paving composition can be improved by lowering the concentration of recovered dust which is introduced to the mixture at any single point. While metering the flow of the recovered dust which is introduced at a single point would appear to offer a solution, the large amount of dust which is typically recovered makes this impractical. Consequently, the present invention provides an apparatus for making asphalt paving, material which includes a heating/drying chamber and a mixing chamber. The heating/drying chamber includes an inlet for aggregate material, a burner that is adapted to heat and dry aggregate material in the heating/drying chamber, a first outlet for gases of combustion and aggregate dust and a second outlet for dried and heated aggregate material.

The mixing chamber includes a first inlet for heated and dried aggregate material, a second inlet for asphalt cement, and a third inlet for aggregate dust which is adapted to distribute the aggregate dust over a substantial portion of the area of the mixing chamber. The mixing chamber also includes means for mixing heated and dried aggregate material and aggregate dust with asphalt cement within the mixing chamber and an outlet for asphalt paving material.

The apparatus also includes means for conveying heated and dried aggregate material from the outlet of the heating/drying chamber to the first inlet of the mixing chamber, means for collecting aggregate dust exiting from the first outlet of the heating/drying chamber and means for conveying this aggregate dust to the third inlet of the mixing chamber.

The invention also includes a method for making asphalt paving materials using the apparatus described above. According to this method, aggregate is introduced into the inlet of the heating/drying chamber, where it is heated and dried. The heated and dried aggregate is conveyed to the first inlet of the mixing chamber and introduced into the mixing chamber through such inlet. Asphalt cement is introduced into the mixing chamber through the second inlet. Dust generated by the motion and the drying of the aggregate is collected as it exits from the first outlet of the heating/drying chamber and conveyed to the third inlet of the mixing chamber and distributed throughout the mixing chamber. The aggregate, dust, and asphalt cement are mixed in the mixing chamber to form asphalt paving material, which is discharged from the mixing chamber.

Stated somewhat more specifically, the preferred embodiment of the present invention includes a drum dryer adapted for rotation about its longitudinal axis. The longitudinal axis of the drum is inclined with respect to horizontal, such that the drum has an upper end and a lower end. A cylindrical fixed shell, concentric with the drum, is disposed to receive the lower end of the drum for rotation within the shell. The inner diameter of the shell is larger than the outer diameter of the drum, so that a mixing chamber is defined between the drum and the outer shell. The preferred apparatus further includes a burner mounted at the lower end of the drum for heating the interior of the drum and an inlet for introducing aggregate into the upper end of the drum. As the drum rotates, aggregate is introduced through the aggregate inlet into the dryer drum where the aggregate is tumbled down the drum tough a flow of heated air and gas. As the aggregate is tumbled and dried, dust is generated. This dust, along with gases of combustion created during the heating and drying process, is removed from the drum through a first outlet. From the first outlet, the dust and gas are conveyed to a baghouse or other similar air or gas filtration means where the dust is separated from the gases and collected for later use, while the gases are vented to the atmosphere. Once heated and dried to the desired levels, the aggregate is discharged from the lower end of the drum and into the mixing chamber. Asphalt cement is also introduced into the mixing chamber, and a plurality of flights or mixing blades are mounted to the exterior of the drum and arranged so as to mix the aggregate, asphalt cement, and other components of the mixture, if any, within the mixing chamber, as the drum rotates and moves the mixture along the shell towards the mixture outlet. A dust inlet is provided to introduce the dust which has been collected in the baghouse into the mixing chamber so that it may be mixed with the aggregate and other materials. The preferred dust inlet of the invention includes a dust distributor which distributes the dust that is introduced into the mixing chamber along its length prior to introducing it into the mixing chamber, thereby reducing the amount of dust which is introduced at any one point. By introducing the recovered dust over a substantial portion of the area of the mixing chamber and thereby reducing, the amount of dust which is introduced at any one point along the mixing chamber, the minimum distance between the dust inlet and mixing chamber outlet which is necessary achieve a thorough blending of the dust into the mixture may be reduced. Furthermore, the introduction of recovered dust over a substantial portion of the area of the mixing chamber reduces the "mixing effort" or the amount of mixing required after the introduction of the recovered dust to the mixing chamber from that of conventional asphalt mixing machines. This reduction in the required mixing effort allows for an increase in the efficiency of the operation of the asphalt mixing plant and generally results in an improved asphalt mixture as compared to conventional asphalt mixing machines.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout and in which.

DESCRIPTION OF THE PREFERRED EMBODIMENT OF THE INVENTION

Figure 1:
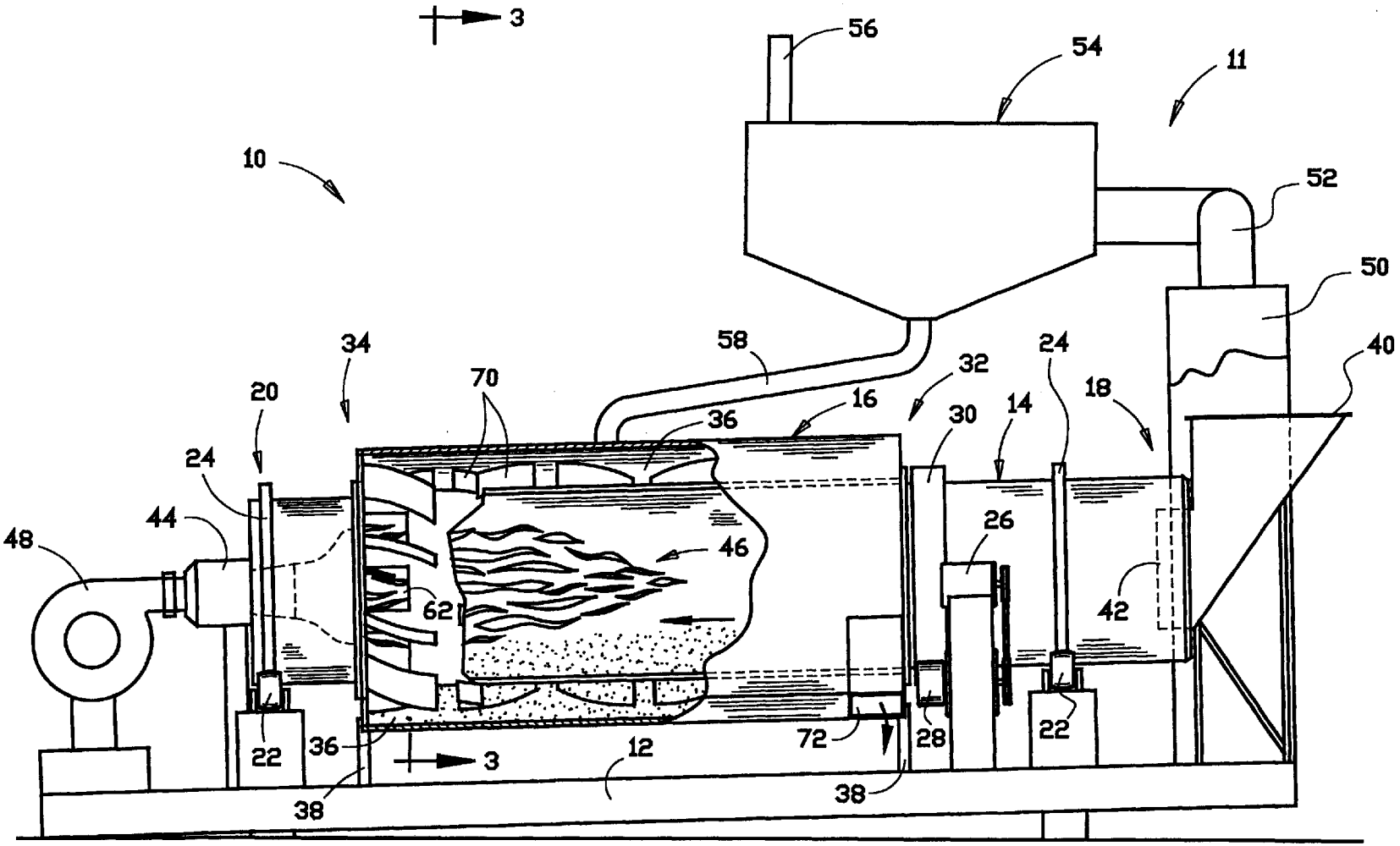
FIG. 1 is a partially cut-away side view of a preferred embodiment of an asphalt plant according to the present invention.
Figure 2:
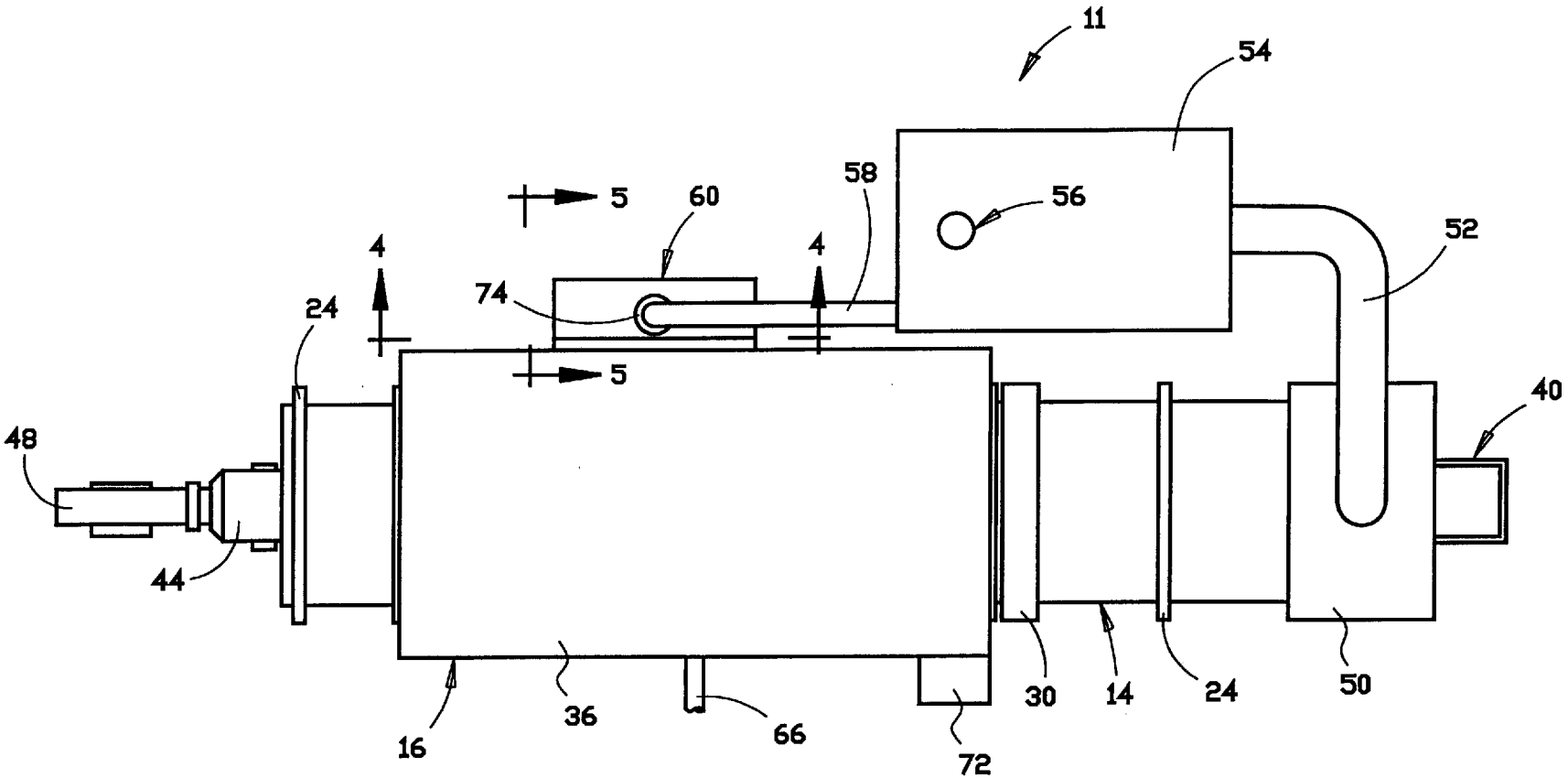
FIG. 2 is a top view of the embodiment of FIG. 1.
Figure 3:
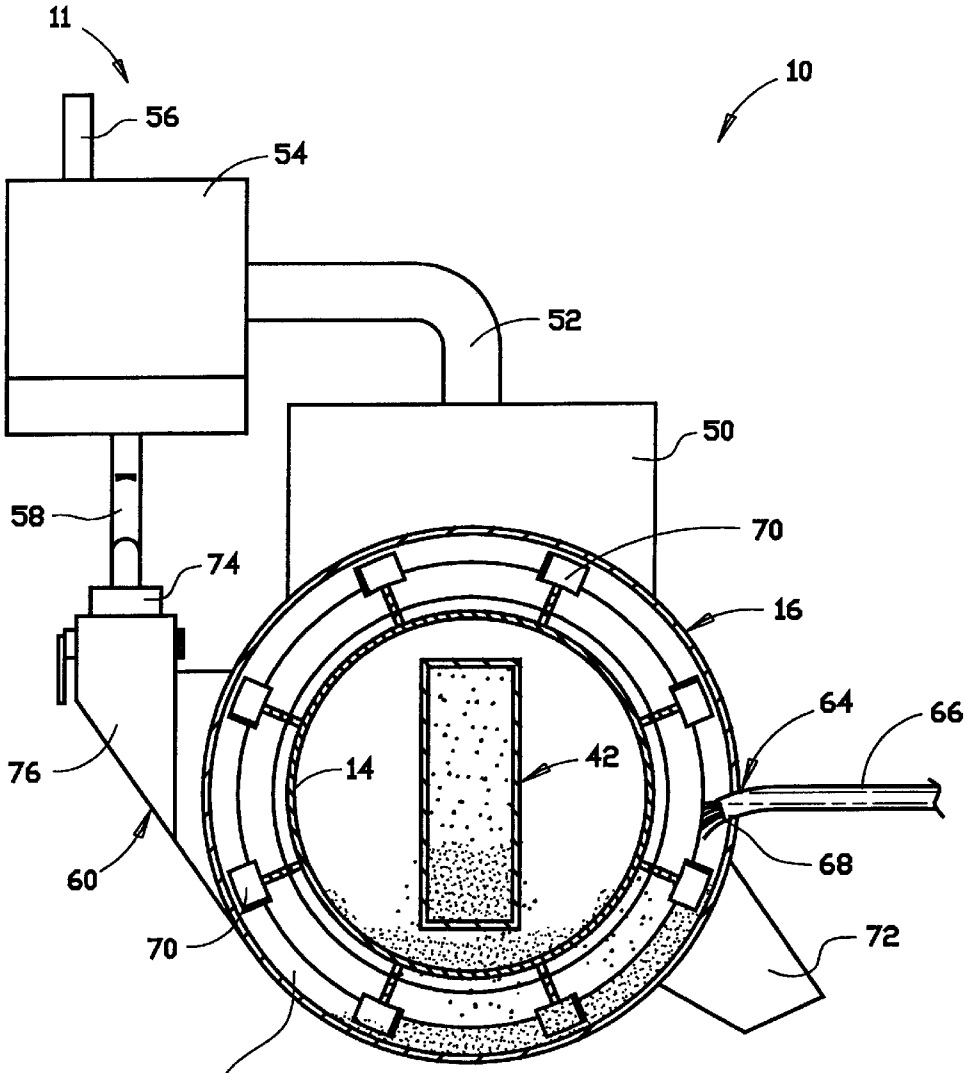
FIG. 3 is a partial cross-sectional view of the asphalt plant of FIG. 1 taken along line 3—3 of FIG. 1.

FIGS. 1 through 3 illustrate a preferred embodiment of a hot-mix asphalt plant or mixing machine 10 having a dust recovery/distribution system 11 according to the invention. As can be seen in FIG. 1, asphalt plant 10 is supported on a frame 12 that may be mounted on wheels (not shown) such that the plant is capable of being transported from one location to another. Plant 10 includes a heating/drying chamber comprised of a generally cylindrical, hollow inclined drum 14 which is adapted to be rotated about its axis, and a generally cylindrical fixed shell 16 that is mounted so as to surround the drum with its axis coincident with the axis of the drum.

Drum 14 is inclined at an angle with respect to the horizontal so that it has an upper end 18 and a lower end 20. The angle at which the plant is operated and transported may be fixed or it may be capable of adjustment by means of a hydraulic lift (not shown). By increasing or decreasing the angle at which the drum is operated, the residence time of the aggregate in the heating/drying chamber may be decreased or increased, respectively, thereby allowing the operator to control the degree to which the aggregate is heated or dried without changing the operation of the burner. Drum 14 is rotatably mounted on frame 12 by means of bearings 22 mounted to the frame which engage races 24 located on the circumference of the drum. A motor 26 is adapted to rotatably drive tire 28 that is in driving engagement with driving surface 30 on the circumference of the drum to rotate the drum 14 in a conventional manner. Alternative drive systems such as are known to those having ordinary skill in the art to which the invention relates may also be employed to rotate the drum.

Since shell 16 is mounted with its axis coincident with the axis of drum 14, it will also be inclined and will therefore have an upper end 32 and a lower end 34. Shell 16 is sized so that an annular mixing chamber 36 is provided between the shell and the drum substantially along the length of the shell. Outer shell 16 is fixedly mounted to the frame 12 on a plurality of supports 38 and encircles at least a portion of drum 14.

Drum 14 includes a chute 40 for introduction of aggregate material, which chute leads to inlet 42 at upper end 18. Due to the inclination and rotation of the drum, the aggregate material will be conveyed towards lower end 20 of the drum by gravity and the effects of rotation of the drum. As the aggregate material is so conveyed, dust will be generated.

The drum assembly also includes a burner 44 at lower end 20 which is adapted to heat and dry the aggregate material within the drum. As shown in FIG. 1, burner 44 is adapted to direct a flame 46 into the interior of the drum. The burner is of conventional design well-known to those skilled in the art to which the invention relates, and can be of an oil, natural gas, LP gas, or coal burning design. Fan 48 is used to introduce a mixture of fuel and air into the burner, where it is ignited to produce the flame used to heat and dry the aggregate which passes through the interior of the drum. The heating and drying chamber preferably includes a plurality of paddles or flights of conventional design mounted to the inner surface of the drum which are used to lift the aggregate as the drum rotates, thereby enabling a more thorough heating and drying of the aggregate as it is passed through the heated air flowing through the drum. An exhaust fan (not shown) may also be employed in combination with burner 44 to direct a flow of heated air from lower end 20 of drum 14, through the drum, and out upper end 18. The exhaust air, which includes gases of combustion and entrained aggregate dust, is directed out of the upper end of the drum 14 through plenum 50 to first outlet 52 of dust recovery/distribution system 11. First outlet 52 conducts the gases of combustion and entrained dust to a conventional dust filtering device 54, such as a baghouse or cyclone separator. Once in the conventional filtering device, the dust or fines are collected for recycling and the gases are vented to the atmosphere through vent 56. The aggregate dust which is collected in filtering device 54 is conveyed through chute 58, under the influence of gravity or by other means known to those having ordinary skill in the art to which the invention relates, to dust distributor 60.

Drum 14 is provided with a second outlet at or near its lower end 20 for discharge of heated aggregate material therefrom. In addition, mixing chamber 36 includes a first inlet for heated and dried aggregate material, which inlet is preferably coincident with the second outlet from drum 14. As shown in FIG. 1, the first inlet of the mixing chamber and the second outlet from the drum in apparatus 10 are coincident and comprised of a plurality of openings 62 in the wall of the shell 16 at its lower end. Thus, heated and dried aggregate material that has been conveyed from upper end 18 of the drum to lower end 20 passes out of the drum and into mixing chamber 36 through openings 62.

Referring now to FIG. 3, mixing chamber 36 also includes a second inlet 64 through the outer wall of shell 16 for introduction of asphalt cement from a storage tank (not shown). It is preferred that the asphalt cement be heated prior to introduction to the mixing chamber, and conventional means are known for storing and heating the asphalt cement and for pumping or otherwise conveying it to the mixing chamber. An asphalt cement supply pipe 66 is provided to conduct asphalt cement through the second inlet and into the mixing chamber. At the end of a preferred embodiment of the supply pipe is a spray nozzle 68, which is oriented toward the bottom of the mixing chamber so that the materials in the bottom of the chamber (see FIG. 3) are evenly sprayed with asphalt cement.

The invention also includes means for mixing heated and dried aggregate material with asphalt cement (and recovered dust, as explained hereinafter) within the mixing chamber. Referring again to FIGS. 1 and 3, a plurality of paddle-like flights or mixing blades 70 are mounted to the exterior of drum 14 within outer shell 16. The flights are arranged so that as drum 14 rotates, the flights span substantially the whole distance between the drum 14 and the outer shell 16. Flights 70 are also angled in such a manner that in addition to mixing the aggregate material, aggregate dust and asphalt cement in the mixing chamber, the flights convey the resulting asphalt paving mixture to outlet 72 of the mixing chamber that is located at or near the upper end of the shell. The asphalt paving material may then be discharged from mixing chamber 36 through outlet 72.

Figure 5:
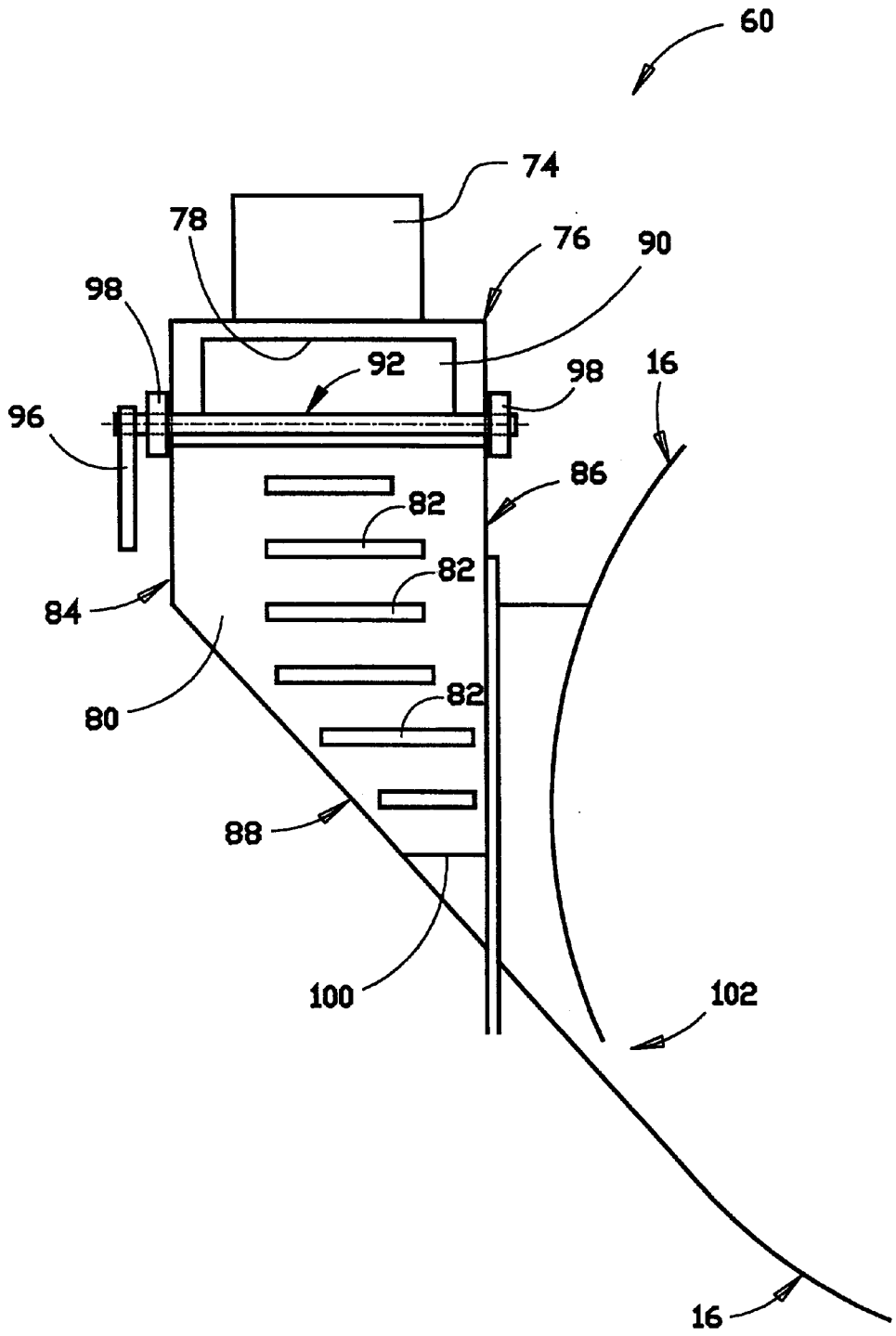
FIG. 5 is a partial cross-sectional view of the dust distributor taken along line 5—5 of FIG. 2.

As shown in FIGS. 2, 3 and 5, a third inlet is provided for admitting aggregate dust to the mixing chamber. This inlet is adapted to distribute the dust throughout the mixing chamber. In preferred apparatus 10, the third inlet to the mixing chamber is provided in the form of dust distributor 60, which introduces to the mixing chamber the dust recovered by dust filtering device 54.

Figure 4:
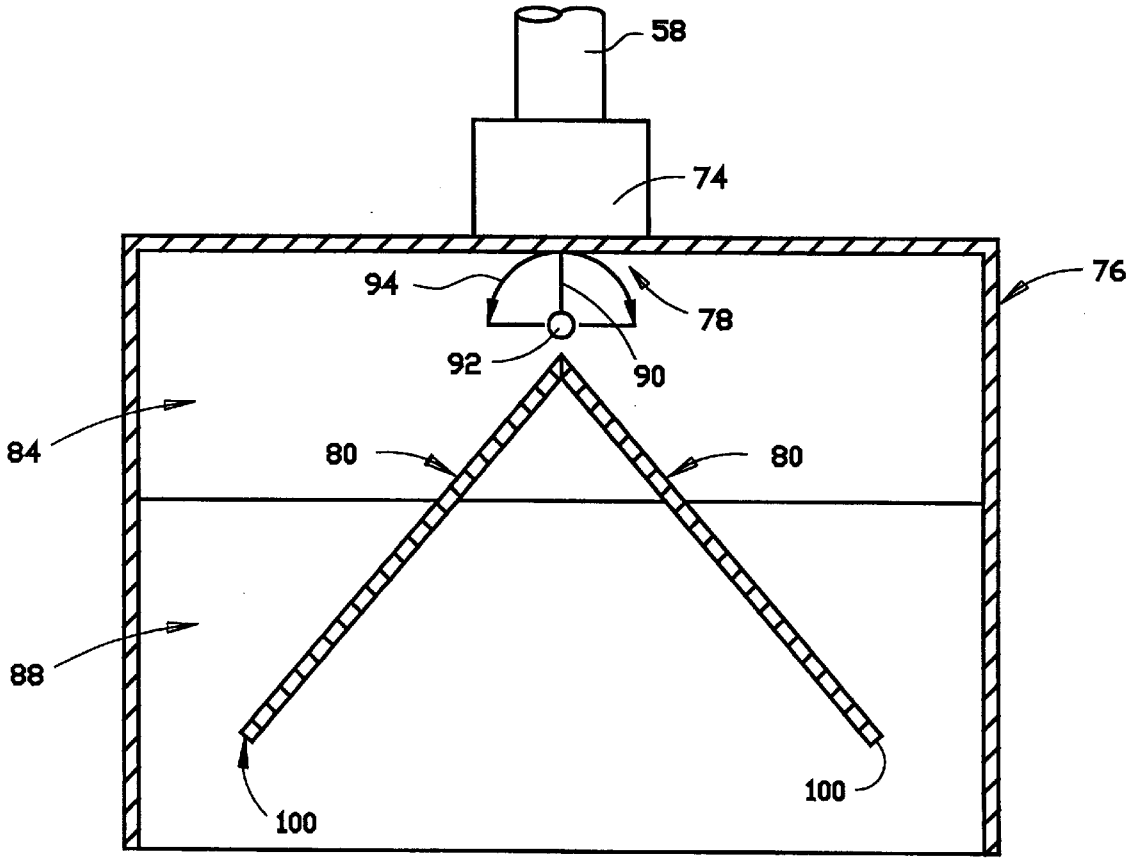
FIG. 4 is a cross-sectional view of the dust distributor of the invention taken along line 4—4 of FIG. 2.

As shown in FIGS. 2, 4 and 5, dust distributor 60 is configured to introduce dust to the mixing chamber along substantially the entire length of apparatus 60, thereby introducing the dust over a substantial portion of the area of the mixing chamber. By introducing the dust over a greater area than has been previously known, the dust will be more evenly distributed throughout the composition in the chamber, thereby reducing the mixing effort required to achieve a thorough blending of the dust into the mixture and improving the quality of the product. Preferably, the dust distributor is adapted to distribute the aggregate dust substantially simultaneously at a plurality of points that are disposed along the length of the mixing chamber, and most preferably, over a length comprising at least about 20% of the length of the mixing chamber.

The embodiment of the dust distributor shown in FIGS. 3, 4 and 5 generally includes chute 74 mounted atop enclosure 76. The point of entry of chute 74 into the enclosure comprises a dust discharge 78 into the enclosure. Within the enclosure and below the chute are disposed a pair of plates 80. Each of plates 80 are mounted at an angle extending downwardly from about the midpoint of the dust discharge in a direction away from the dust discharge, as best shown in FIG. 4. Preferably, the plates are mounted at an angle within the range of about 45° to about 55° from the horizontal. The invention also contemplates that the plates may be adjustably mounted so that the downward angle thereof may be changed.

As shown in FIG. 5, plates 80 are provided with a plurality of slots 82 that are spaced along the length of the dust distributor. These slots are spaced apart and arranged so that a portion of the dust discharging onto each plate will fall through each slot, thereby limiting the amount of dust that will fall through the plates at any particular point. While FIG. 5 shows that each of slots 82 is arranged lengthwise on a plate 80 in a substantially horizontal orientation, other orientations are contemplated. It is also contemplated that the term slot or slots includes any and all variations of openings which would allow the dust to pass therethrough in the desired manner. The size, shape and spacing of the slots may also be varied depending upon the desired distribution along the length of the dust distributor and upon the shape and orientation of the slots used.

As shown in FIG. 5, plates 80 of dust distributor 60 extend between back side plate 84 and front side plate 86 of dust distributor enclosure 76, and are preferably positioned inside the dust distributor substantially perpendicular to both side plates 84 and 86 (see FIG. 4). FIG. 5 also illustrates the sloping base 88 of dust distributor 60. The sloping base extends from back side plate 84 of distributor 60 to the outer shell 16 of plant 10, and the rear edges of plates 80 are supported by back side plate 84 and sloping base 88. It is further contemplated that the angle or slope of sloping base 88 as well as the length of sloping base 88 and side plates 84 and 86 may be varied to accommodate plates of different sizes and shapes.

Figure 6:
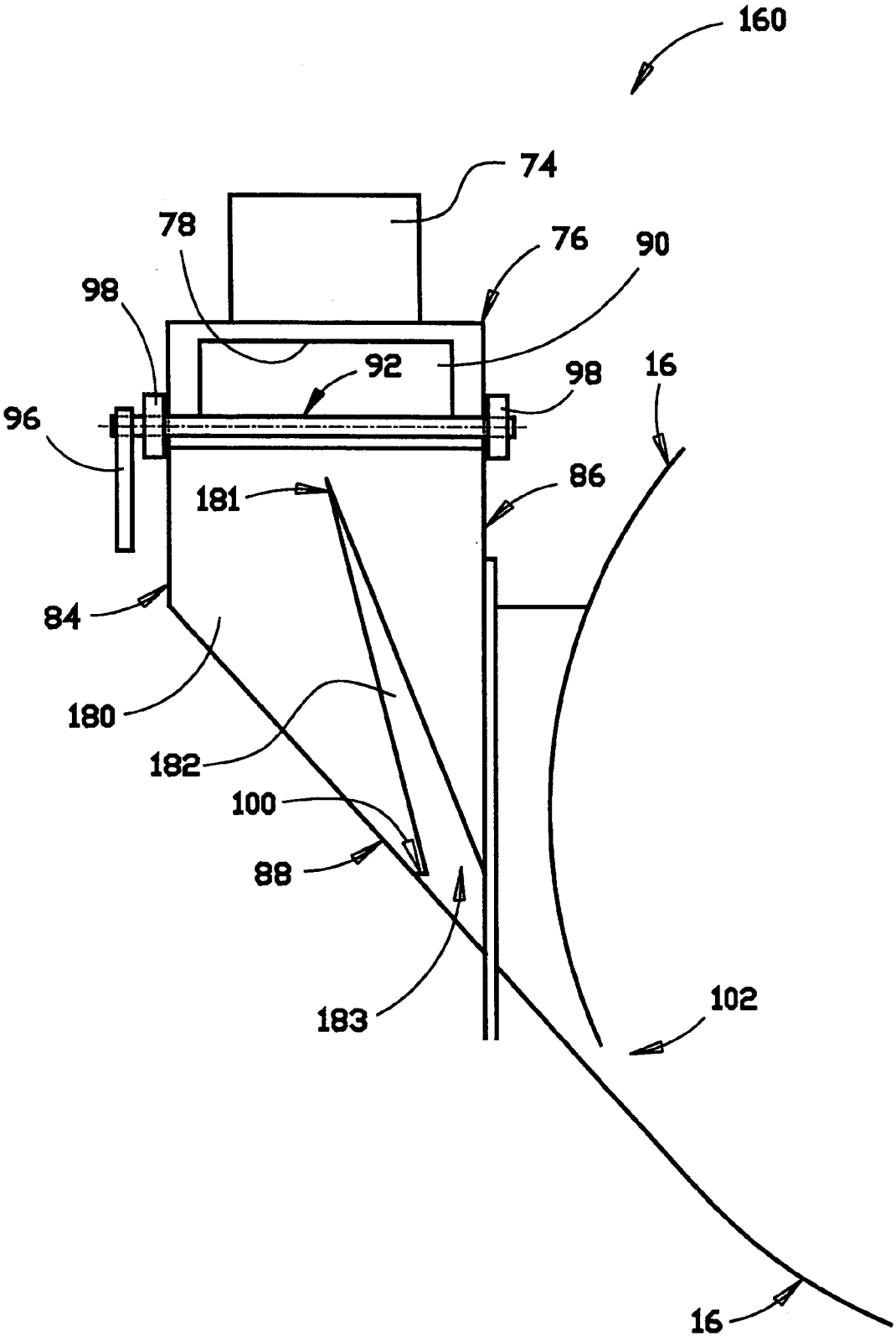
FIG. 6 is a partial cross-sectional view of an alternative embodiment of the dust distributor taken along line 5—5 of FIG. 2.

Another embodiment of the dust distributor is shown in FIG. 6. Distributor 160 includes a pair of plates 180 which are mounted at an angle extending downwardly from about the midpoint of the dust discharge in a direction away from the dust discharge. Consequently, a front view of distributor 160 would be virtually identical to FIG. 4, which illustrates a front view of distributor 60. Each of plates 180 in distributor 160 has at least one slot 182, said slot having an upper end 181 and a lower end 183. Upper end 181 of the slot is positioned closer to dust discharge 78 than lower end 183, and slot 182 has a greater width at the lower end 183 than at the upper end 181. Plates 180 of dust distributor 160 extend between back side plate 84 and front side plate 86 of dust distributor enclosure 76, and are preferably positioned inside the dust distributor substantially perpendicular to both plates 84 and 86 (similar to the illustration of distributor 60 shown in FIG. 4). FIG. 6 also illustrates the sloping base 88 of dust distributor 160. The sloping base extends from back side plate 84 of distributor 160 to the outer shell 16 of plant 10, and the rear edges of plates 180 are supported by back side plate 84 and sloping base 88.

The dust distributor also includes an adjustable flow diverter 90, which is located just beneath dust discharge 78. As shown in FIGS. 4, 5 and 6, the diverter is mounted on shaft 92 which extends through enclosure 76, and is adapted to be rotated to substantially any angular position with respect to the horizontal from 0° to 180°, as shown by arrow 94 in FIG. 4. Handle 96 is provided to rotate the shaft, and spacers 98 are provided to maintain sufficient tension between plates 84 and 86 so that the diverter will remain in whatever angular configuration is desired. When the diverter is placed in a 90° orientation, as shown in FIG. 4, the dust which is conveyed through dust discharge 78 will be discharged substantially evenly on both plates of the distributor. A rotation of handle 96 allows the operator to control the ratio of dust which is discharged onto each of the plates. Since diverter 90 is sized so that when oriented horizontally, it will extend from shaft 92 to one side or the other of dust discharge 78, it may be rotated so that either of the plates in the distributor receives substantially all, some or substantially none of the dust entering the distributor through the discharge.

As the dust enters dust distributor 60 from chute 74, the dust is discharged through dust discharge 78 onto plates 80. Because of the size of the dust discharge, the dust will fall onto a substantial portion of the width of the plates. Because of the slope of the plates and the positioning of the slots 82 therethrough, the dust that is discharged onto the plates will spread down along the length thereof, under the influence of gravity, and pass through the various slots 82 onto sloping base 88. As described above, slots 82 are spaced apart, sized and arranged so that only a portion of the dust discharged on the plates 80 will fall through each slot; however, because of the slope of the plates and the arrangement of the slots, dust will fall through the slots substantially simultaneously. Any dust which does not fall through one of the slots will fall off the ends 100 of the plates onto the sloping base. Dust falling onto the sloping base will slide down the base through inlet slot 102 in the side of shell 16 and into the mixing chamber. Although not shown in the drawings, inlet slot 102 preferably extends along the entire length of the dust distributor so that it will serve to distribute the aggregate dust substantially simultaneously at a plurality of inlet points along the length of the mixing chamber.

Similarly, as dust from chute 74 enters dust distributor 160, the dust is discharged though dust discharge 78 onto plates 180. Because of the size of the dust discharge, the dust will fall onto a substantial portion of the width of the plates. Because of the slope of each of plates 180 and the positioning of each slot 182 thereon, the dust that is discharged onto the plates will spread down along the length thereof, under the influence of gravity, and pass through the slots onto sloping base 88. As described above, slots 182 are positioned on plates 180 so that only a portion of the dust will fall through to sloping base 88 at a single point along the slot; however, because of the slope of plates 180 and the arrangement and varying width of slots 182, the dust will pass through plates 180 at several locations along its length substantially simultaneously. Any dust which does not fall through the slots will fall off the ends 100 of the plates onto the sloping base. Dust falling onto the sloping base will slide down the base through inlet slot 102 in the side of shell 16 and into the mixing chamber. Thus dust from distributor 160 will therefore enter the mixing chamber across a substantial portion of the area thereof, instead of at a single entry point. Preferably, the dust distributor will evenly introduce the aggregate dust over an area comprising at least about 20% of the length of the mixing chamber.

Those having ordinary skill in the art to which the invention relates will appreciate that the invention provides a method and apparatus for manufacturing asphalt paving compositions which minimizes the problems caused by the introduction of the recovered dust into the mixing chamber at a single point. The quality of the asphalt paving compositions produced according to the invention is improved by introducing and dispersing the recovered aggregate dust over a substantial portion of the area of the mixing chamber.

Although this description contains many specifics, these should not be construed as limiting the scope of the invention but merely as providing illustrations of the some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. An apparatus for making asphalt paving material, which apparatus comprises:

(A) a heating/drying chamber which includes:
(i) an inlet for aggregate material;
(ii) a burner that is adapted to heat and dry aggregate material in the heating/drying chamber;
(iii) a first outlet for gases of combustion and aggregate dust;
(iv) a second outlet for dried and heated aggregate material;

(B) means for collecting aggregate dust exiting from the first outlet of the heating/drying chamber;

(C) a mixing chamber which includes:
(i) a first inlet for heated and dried aggregate material;
(ii) a second inlet for asphalt cement;
(iii) a third inlet for aggregate dust, said inlet being adapted to distribute the aggregate dust over a substantial portion of the area of the mixing chamber;
(iv) means for mixing heated and dried aggregate material and aggregate dust with asphalt cement within the mixing chamber;
(v) an outlet for asphalt paving material;

(D) means for conveying heated and dried aggregate material from the outlet of the heating/drying chamber to the first inlet of the mixing chamber;

(E) means for conveying aggregate dust collected from the first outlet of the heating/drying chamber to the third inlet of the mixing chamber.

2. The apparatus of claim 1 wherein the mixing chamber has a length as measured along a line from the first inlet to the outlet, and wherein the third inlet of the mixing chamber is adapted to distribute the aggregate dust at a plurality of points that are disposed along the length of the mixing chamber.

3. The apparatus of claim 2 wherein the third inlet of the mixing chamber is adapted to distribute the aggregate dust over a length comprising at least about 20% of the length of the mixing chamber.

4. The apparatus of claim 3 wherein (A) the third inlet comprises a chute having a dust discharge and a pair of plates mounted therebelow, each of said plates being mounted at an angle extending downwardly from about the midpoint of the dust discharge and having a length in a direction away from the dust discharge and a plurality of slots along said length which are spaced apart and arranged so that a portion of the dust discharging onto the plate will fall through each slot; or (B) the third inlet comprises a chute having a dust discharge and a pair of plates mounted therebelow, each of said plates being mounted at an angle extending downwardly from about the midpoint of the dust discharge and having a length in a direction away from the dust discharge and at least one slot along said length, wherein each such slot has an upper end and a lower end, and a greater width at the lower end than the upper end.

5. The apparatus of claim 4 wherein each of the plates is adjustably mounted so that the downward angle thereof may be changed.

6. The apparatus of claim 4 wherein the downward angle of each plate is within the range of about 45° to about 55° from the horizontal.

7. An apparatus for making asphalt paving material comprising:

(A) a generally cylindrical, hollow inclined drum having an upper end and a lower end, which drum is adapted to be rotated about its axis, said drum having:
(i) in inlet at its upper end for aggregate material;
(ii) a burner at its lower end which is adapted to heat and dry aggregate material within the drum;
(iii) a first outlet at or near its upper end for discharge of gases of combustion and aggregate dust therefrom;
(iv) a second outlet at or near its lower end for discharge of heated aggregate material therefrom;

(B) means for rotating the drum about its axis;

(C) means for collecting aggregate dust exiting from the first outlet of the drum;

(D) a generally cylindrical fixed shell that is mounted so as to surround the drum with its axis coincident with the axis of the drum, said shell being sized so that an annular mixing chamber is provided between the shell and the drum, said mixing chamber including:
(i) a first inlet for heated and dried aggregate material, said inlet being coincident with the second outlet from the drum;
(ii) a second inlet for asphalt cement;
(iii) a third inlet for aggregate dust, said inlet being adapted to distribute the aggregate dust over a substantial portion of the area of the mixing chamber;
(iv) an outlet for asphalt paving material that is located at or near the upper end of said shell;

(E) means for mixing heated and dried aggregate material and aggregate dust with asphalt cement within the mixing chamber;

(F) means for conveying aggregate dust collected from the first outlet of the drum to the third inlet of the shell;

(G) means for conveying the mixture of aggregate material, aggregate dust and asphalt cement to the outlet of the mixing chamber.

8. The apparatus of claim 7 wherein the means for mixing heated and dried aggregate material and aggregate dust with asphalt cement within the mixing chamber and the means for conveying said mixture to the outlet for asphalt paving material comprises a plurality of flights that are mounted to the exterior of the drum and arranged so as to mix the aggregate material, aggregate dust and asphalt cement within the mixing chamber and to convey the mixed material to the outlet of the shell.

9. The apparatus of claim 8 wherein the third inlet of the annular mixing chamber is adapted to distribute the aggregate dust along at least about 20% of the axial length of the mixing chamber.

10. The apparatus of claim 8 wherein the third inlet of the mixing chamber is adapted to distribute the aggregate dust substantially simultaneously at a plurality of inlet points that are disposed along the axis of the shell.

11. The apparatus of claim 8 wherein:

(A) the third inlet comprises a chute having a dust discharge and a pair of plates mounted therebelow, each of said plates being mounted at an angle extending downwardly from about the midpoint of the dust discharge and having a length in a direction away from the dust discharge and a plurality of slots along said length which are spaced apart and arranged so that a portion of the dust discharging onto the plate will fall through each slot; or (B) the third inlet comprises a chute having a dust discharge and a pair of plates mounted therebelow, each of said plates being mounted at an angle extending downwardly from about the midpoint of the dust discharge and having a length in a direction away from the dust discharge and at least one slot along said length, wherein each slot has an upper end and a lower end, and a greater width at the lower end than the upper end.

12. The apparatus of claim 11 wherein each of the plates is adjustably mounted so that the downward angle thereof may be changed.

13. The apparatus of claim 11 wherein the downward angle of each plate is within the range of about 45° to about 55° from the horizontal.

14. A method for making asphalt paving material comprising:

(A) providing an apparatus comprising:
- (i) a heating/drying chamber which includes:
  - (a) an inlet for aggregate material;
  - (b) a burner that is adapted to heat and dry aggregate material in the heating/drying chamber;
  - (c) a first outlet for gases of combustion and aggregate dust;
  - (d) a second outlet for dried and heated aggregate material;
- (ii) means for collecting aggregate dust exiting from the first outlet of the heating/drying chamber;
- (iii) a mixing chamber which includes:
  - (a) a first inlet for heated and dried aggregate material;
  - (b) a second inlet for asphalt cement;
  - (c) a third inlet for aggregate dust, said inlet being adapted to distribute the aggregate dust over a substantial portion of the area of the mixing chamber;
  - (d) means for mixing heated and dried aggregate material and aggregate dust with asphalt cement within the mixing chamber;
  - (e) an outlet for asphalt paving material;
- (iii) means for conveying heated and dried aggregate material from the second outlet of the heating/drying chamber to the first inlet of the mixing chamber;
- (iv) means for conveying, aggregate dust collected from the first outlet of the heating/drying chamber to the third inlet of the mixing chamber;

(B) introducing aggregate material into the inlet of the heating/drying chamber;

(C) activating the burner to heat and dry the aggregate material in the heating/drying chamber;

(D) collecting aggregate dust exiting from the first outlet of the heating/drying chamber;

(E) conveying aggregate dust collected from the first outlet of the heating/drying chamber to the third inlet of the mixing chamber;

(F) distributing aggregate dust over a substantial portion of the area of the mixing chamber;

(G) discharging dried and heated aggregate material from the heating/drying chamber;

(H) conveying dried and heated aggregate material to the first inlet of the mixing chamber;

(I) introducing dried and heated aggregate material into the mixing chamber through the first inlet;

(J) introducing asphalt cement into the mixing chamber through the second inlet;

(K) mixing aggregate material, aggregate dust and asphalt cement in the mixing chamber to form asphalt paving material;

(L) conveying asphalt paving material to the outlet of the mixing chamber;

(M) discharging asphalt paving material from the mixing chamber.

15. The method of claim 14 which includes distributing the aggregate dust over an area comprising at least about 20% of the length of the mixing chamber.

16. The method of claim 14 which includes providing an apparatus with a mixing chamber having a length as measured along a line from the first inlet to the outlet, and which also includes distributing the aggregate dust at a plurality of inlet points that are disposed along the length of the mixing chamber.

17. The method of claim 16 which includes providing an apparatus with a mixing chamber having a third inlet which comprises a chute having a dust discharge and a pair of plates mounted therebelow, each of said plates being mounted at an angle extending downwardly from about the midpoint of the dust discharge and having a length in a direction away from the dust discharge and a plurality of slots along said length which are spaced apart and arranged so that a portion of the dust discharging onto the plate will fall through each slot.

* * * * *